US006641011B1

(12) United States Patent
Kahn

(10) Patent No.: US 6,641,011 B1
(45) Date of Patent: Nov. 4, 2003

(54) HAND-HELD TOOL HOLDER

(76) Inventor: Peter P. Kahn, 381 S. Country Rd., Brookhaven Hamlet, NY (US) 11719

( * ) Notice: Subject to any disclaimer, the term of this patent is extended or adjusted under 35 U.S.C. 154(b) by 0 days.

(21) Appl. No.: 10/338,855

(22) Filed: Jan. 9, 2003

(51) Int. Cl.[7] ..... A45F 5/00
(52) U.S. Cl. ..... 224/269; 224/666; 224/904
(58) Field of Search ..... 224/250, 269, 224/666, 904

(56) References Cited

U.S. PATENT DOCUMENTS

| | | | | | |
|---|---|---|---|---|---|
| 2,618,419 | A | * | 11/1952 | Vanish | 224/904 |
| 3,227,336 | A | | 1/1966 | Dickey | |
| 3,285,482 | A | | 11/1966 | Bedsaul, Sr. | |
| 4,319,704 | A | | 3/1982 | Rosen | |
| D275,527 | S | * | 9/1984 | Gee | 224/666 |
| 4,917,281 | A | * | 4/1990 | Ostermiller | 224/666 |
| 5,497,921 | A | | 3/1996 | Dancyger et al. | |
| 5,673,830 | A | | 10/1997 | Matthews | |
| 5,971,238 | A | * | 10/1999 | Malvasi et al. | 224/269 |
| 6,000,591 | A | * | 12/1999 | Alexander | 224/250 |
| 6,193,125 | B1 | | 2/2001 | Grover | |
| 6,325,577 | B1 | * | 12/2001 | Anderson | 224/904 |
| 6,499,637 | B1 | * | 12/2002 | Zamarron | 224/904 |

* cited by examiner

*Primary Examiner*—Gary E. Elkins
(74) *Attorney, Agent, or Firm*—Peter A Borsari

(57) ABSTRACT

A simple and sturdy holder for hand-held tools comprising a belt clip for attachment to a user's belt, an angled hook which is retained at one end by the belt clip and a strap member for securely retaining a hand-held tool. Attachment of the strap member to the belt clip permits the thus-held tool to be carried conveniently by the workman without requiring the use of his hands. Ideally, the belt clip may be manufactured in standardized lengths to permit the use of the tool holder with belts of varying, common widths. An optional cushioning device may be used to provide padding against the body of the workman and, thereby, to improve comfort.

9 Claims, 2 Drawing Sheets

HAND-HELD TOOL HOLDER

FIELD OF INVENTION

The present invention relates generally to the field of holders for hand-held tools, and in particular to a holder for cumbersome or weighty tools such as an air gun, power drill and the like wherein the holder is attachable to a user's clothing such as to a belt or utility belt. More specifically, the present invention relates to a

BACKGROUND OF THE INVENTION

Tool holders of varying designs have been produced in order to assist the workman in conveniently and safely carrying tools about the work space. Among these tool holders is a class of tool holders for hand-held tools with which the carried tool is disposed at the user's waist level, generally depending from the user's clothing such as a belt or utility belt. By utilizing such a holder, the user is not encumbered by the need to carry the tool with either hand, but rather, passively carries the tool within the confines of the holder attached to his clothing.

The prior art is replete with devices for holding tools, including hand-held tools, paint cans and other objects. For example, U.S. Pat. No. 3,227,336, issued Jan. 4, 1966 to Roy F. Dickey discloses a belt suspended holster including an interior shield disposed within the wearer's trousers, which is used to protect clothing from gun oil. U.S. Pat. No. 3,285,482, issued Nov. 15, 1966 to James D. Bedsaul, Sr. and U.S. Pat. No. 4,319,704, issued Mar. 16, 1982 to Louis M. Rosen disclose belt clip devices having hip engaging supports. In U.S. Pat. No. 5,497,921, issued Mar. 12, 1996 to Michael Dancyger et al., a paint can holder is provided which includes a main body looped about the belt and strapping means for securing a paint can.

U.S. Pat. No. 5,673,830, issued Oct. 7, 1997 to Arthur T. Matthews provides a belt supported pneumatic nail gun holder comprising a support element having slots for adjustably positioning the element onto the user's belt, a mounting plate fixedly secured to the support element, a hook shaped retaining member secured to the mounting plate and a detachable hook which attaches to the hook shaped retaining member and the tool. The Matthews device is more difficult to manufacture and cumbersome to use. In addition, the use of the slots for engaging the user belt can result in the slots tearing when heavy hand-held tools are used. Further, Matthews does not provide any cushioning means between the tool and the user.

U.S. Pat. No. 6,193,125, issued Feb. 27, 2001 to Ralph E. Grover, a locking tool holder is disclosed for mounting to a person's belt or pocket, the holder comprising a clamping device and a biasing device which clamps and positions the tool respectively. The biasing device of Grover appears to be complicated to manufacture and contains movable parts which could lend to failure of the device.

Despite the teachings of the prior art, a need still exists for a simple yet sturdy holder, particularly for hand-held tools which are not provided with means to easily engage a hook member. Such a hand-held tool holder should be capable of carrying hand-held tools of varying dimensions and weights without the need for complicated adjustment mechanisms. In addition, such a device should be easy to use and should provide a cushioning effect between the hand-held tool and the user. Further, such a device should be of few parts and inexpensive to manufacture.

SUMMARY OF THE INVENTION

Accordingly, it is an object of the present invention to provide a hand-held tool holder which is capable of carrying tools of varying dimensions and weights.

It is another object of the present invention to provide a hand-held tool holder which can accommodate hand-held tools which are not provided with means to easily engage a hook member.

It is also an object of the present invention to provide a hand-held tool holder which is simple to use and inexpensive to purchase.

It is an additional object of the present invention to provide a hand-held tool holder which includes cushioning means between the tool and the user.

It is a further object of the present invention to provide a hand-held tool holder which is of few parts and inexpensive to manufacture.

Additional objects, advantages and novel features of the invention will be set forth in part of the description which follows, and in part will become apparent to those skilled in the art upon examination of the following specification or may be learned by practice of the invention.

These and other objects of the present invention are accomplished by providing a hand-held tool holder comprising a belt clip having a hook member integral therewith, a strap member adapted to be secured about the hand-held tool and being provided with an aperture for engaging the hook member, and a cushioning device which maybe integral with the belt-clip or may be a separate component adapted to be introduced over the belt clip.

BRIEF DESCRIPTION OF THE DRAWINGS

The present invention will be better understood with reference to the appended drawing sheets, wherein.

DETAILED DESCRIPTION

Figure 1:
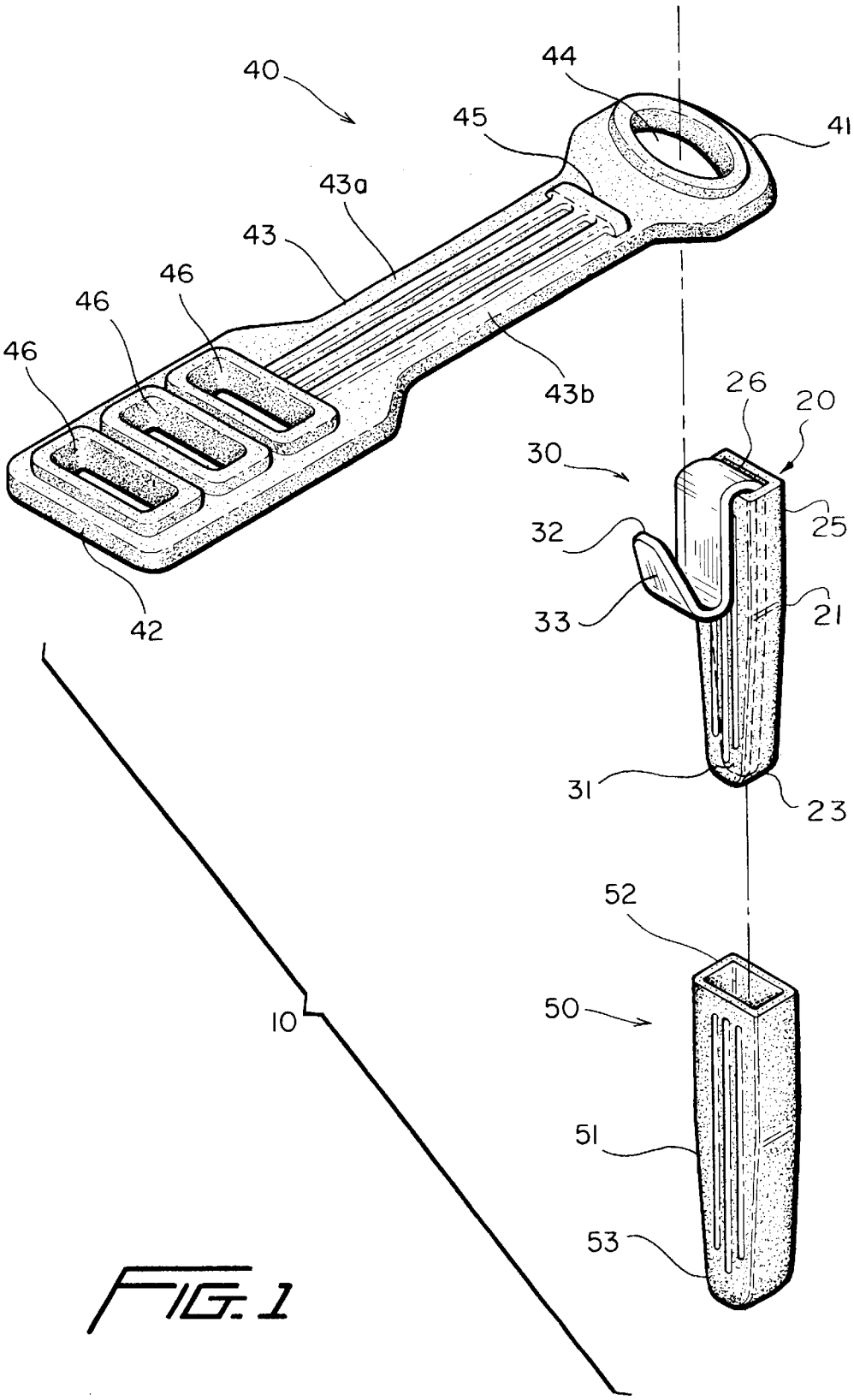
FIG. 1 is an exploded perspective view of the hand-held tool holder of the instant invention.
Figure 2:
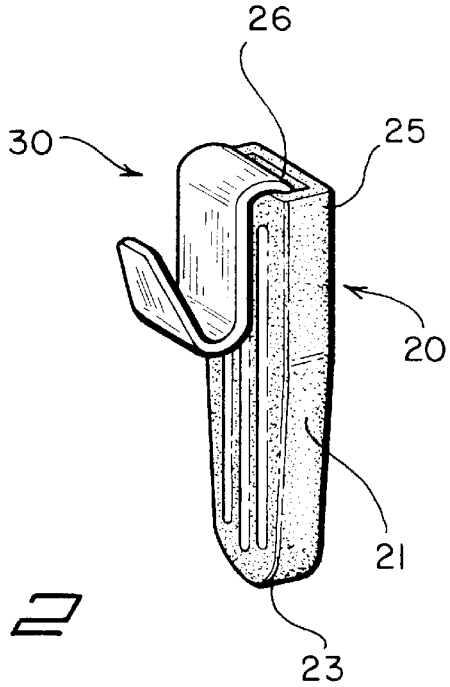
FIG. 2 is a perspective view of the belt clip body of the hand-held tool holder of the instant invention, the belt clip body having an outer foam layer.

The present invention relates to a hand-held tool holder which is attachable to a user's clothing, such as a user's waist band, belt or utility belt. As shown in FIGS. 1 and 2, the hand-held tool holder 10 (hereinafter sometimes referred to as "tool holder" or "holder") comprises a belt clip 20 having a hook member 30 integral with the belt clip, a strap member 40 adapted to be secured to a hand-held tool and having an aperture for engaging the hook member 30 and optionally a cushioning pocket 50.

The belt clip 20 comprises a body 21 having a lower end 23 and an upper end 25. The length of the body 21 of the belt clip 20 can be selected to extend beyond the width of a user's belt as will be well known to practitioners in the art. In manufacture, standard lengths can be chosen to accommodate the most common belt widths found in use. To facilitate the insertion of the belt clip over the user's clothing and behind the user's belt, the lower end 23 of the belt clip 20 can be tapered. Optionally, the lower end can be rounded to further facilitate insertion of the belt clip. An opening 26 is provided in the top end 25 of the belt clip within which one end of the hook member 30 is affixed therein.

The hook member 30 comprises a first end 31 which is adapted to be affixed to the belt clip body 21 and second end 33 which is formed into an "J" shaped hook 32. The first end 31 of the hook member 30 can be retained permanently in the belt clip 20 by means well known in the art, suitable examples of which include heat sealing and adhesive means. Alternatively, the belt clip can be manufactured integrally with hook member, such as by injection molding. The belt clip body 21 can be coated or dipped with a foam material to form a cushioned outer layer, as shown in FIG. 2. Suitable foam materials include, for example, rubber, plastic and plastic composites having a shore hardness of from 20 to 35. The belt clip body 21 and the hook member 30 can be composed from a variety of relatively rigid materials, including for example, plastic and plastic composite materials.

The strap member 40 comprises a first end 41, a second end 42 and a strap body 43 between said first and second ends. The first end 41 of the strap member 40 flares outwardly from strap body 43, thus having a width greater than that of strap body 43. An aperture 44 is provided within the first end 41, the aperture 44 being adapted to be introduced over the J-shaped hook 32 of second end 33 of the hook member 30. The second end 42 of the strap member 40 also flares outwardly from strap body 43, thus also having a width greater than that of strap body 43. At least one opening 46 is provided within the second end 42, the at least one opening 46 having a diameter less than the width of first end 41. In a preferred embodiment, the second end 42 is provided with three identical openings 46. The strap member 40 can be composed of any material which is both sufficiently strong to retain a power tool, such as a power drill, and sufficiently flexible such that the first end 41 of strap member 40 can be twisted and threaded through the opening 46. Suitable materials include rubber material and rubber-plastic composites having a shore hardness of from about 50 to about 60. Once first end 41 has been twist-threaded through opening 46, its larger width prevents it from being back-threaded through opening 46. Without additional manipulation, a continuous loop is formed with aperture 44 outside the loop and free to engage the J-shaped hook 32.

Optionally, the hand-held tool holder of the present invention further comprises a cushioning pocket 50 adapted to receive the lower end 23 of the belt clip. The cushioning pocket 50 can be fabricated from any material which is relatively softer than that of the belt clip 20. Suitable materials for the cushioning device 50 include for example rubber, plastic and plastic composites having a shore hardness of from about 20 to about 35. The cushioning device comprises a housing 51 having an opened upper end 52 adapted to receive and securely retain the belt clip 20 and a closed end 53. The cushioning device 50 and belt clip 30 may be fabricated as a one-piece integral unit, as will be obvious to those skilled in the art.

Figure 3:
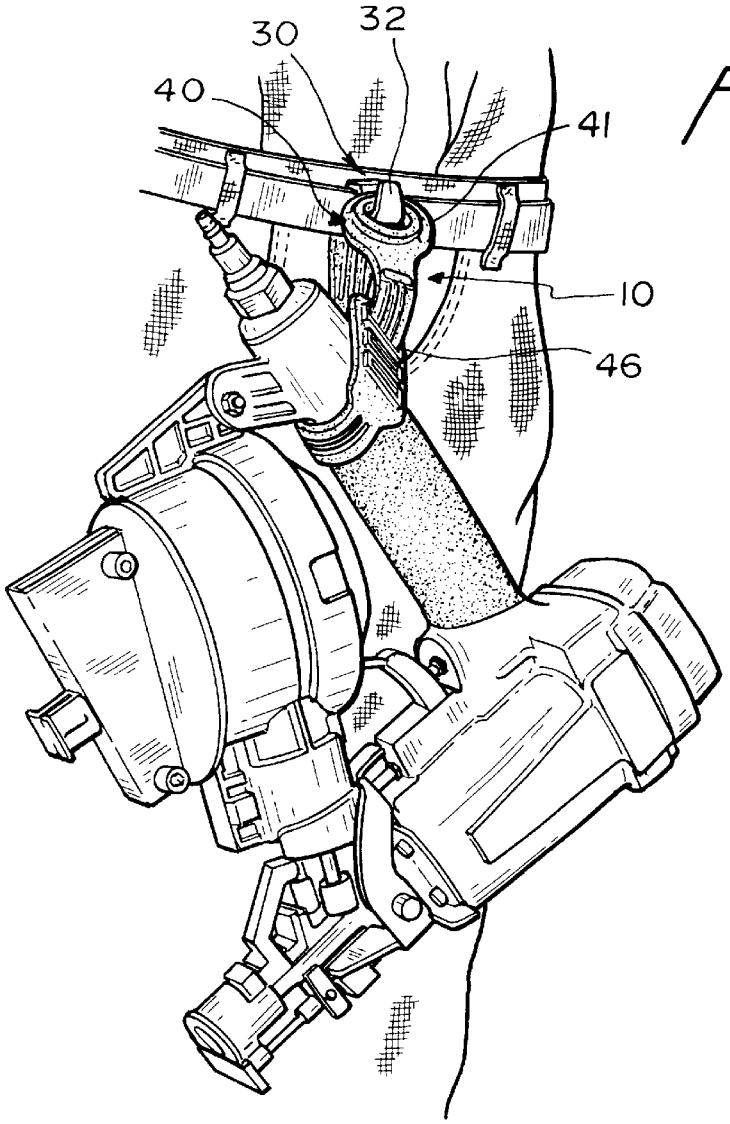
FIG. 3 is an environmental perspective view of the hand-held tool holder of the instant invention showing the holder in use when attached to a user's belt and when holding a tool.

Referring now to FIG. 3, the tool holder 10 is shown attached to a user's belt between the belt clip body and hook member. It is to be understood that sufficient clearance between the belt clip body and hook member exists to permit positioning of the belt clip body on one side of the user's belt. Strap member 40 is wrapped tightly about an object which is desired to be hung from the hook member 30. As shown in FIG. 3, strap member 40 is wrapped tightly about the handle of a power drill and first end 41 is twist-threaded through the first exposed opening 46 thereby securely wrapping the strap member about the power drill handle. The power drill, now secured to the strap member 40, can be hung from the hook member 30 by introducing aperture 44 of first end 41 over said J-shaped hook 32.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A tool holder adapted for carrying a tool, comprising (1) a belt clip having an upper end, a lower end and a belt clip body therebetween;

(2) a hook member having a first end, a second end terminating into a "J" shaped hook, said first end adapted to be permanently affixed to said belt clip; and (3) a strap member having a first end provided with an opening adapted to be introduced over said "J" shaped hook member, a second end provided with at least one aperture, and a strap body between said first end and said second end, said strap body having a first width, said first end having a second width which is greater than said first width of said strap body and said second end having a third width which is greater than said first width of said strap body, and said at least one aperture in said second end having a diameter less than the width of said first end of said strap member, such that said first end of said strap member can be twist-threaded through said at least one aperture of said second end, wherein, said strap member is secured to a tool by tightly wrapping said strap member about a tool and twist-threading said first end of said strap member through one of said at least one aperture of said second end, thereby enabling the thus-secured tool to be depended from said hook member of said tool holder.

2. The tool holder in accordance with claim 1, wherein said strap member is fabricated from a rubber material having a shore hardness of from about 50 to about 60.

3. The tool holder in accordance with claim 1, wherein said belt clip and said hook member are fabricated as an integral unit, said first end of said hook member being permanently embedded within said belt clip.

4. The tool holder in accordance with claim 1, wherein an adhesive is used to permanently embed said first end of hook member within said belt clip.

5. The tool holder in accordance with claim 1, further comprising a cushioning pocket having an opened first end, a closed second end, and a housing for securely retaining said belt clip therein.

6. The tool holder in accordance with claim 5, wherein said cushioning pocket is fabricated from a material relatively softer than that from which said belt clip is manufactured.

7. The tool holder in accordance with claim 6, wherein said cushioning pocket is fabricated from a material having a shore hardness of from about 20 to about 35.

8. The tool holder in accordance with claim 5, wherein said cushioning pocket is integral with said belt clip.

9. The tool holder in accordance with claim 7, wherein an adhesive permanently bonds said belt clip within said cushioning pocket.

* * * * *